United States Patent [19]

Gallagher et al.

[11] 4,154,189

[45] May 15, 1979

[54] MANUAL RELEASE AND TEST APPARATUS FOR ALARM SYSTEM

[75] Inventors: Edward L. Gallagher, San Clemente; John Gardner, Fountain Valley, both of Calif.

[73] Assignee: Ato, Inc., Willoughby, Ohio

[21] Appl. No.: 869,348

[22] Filed: Jan. 13, 1978

[51] Int. Cl.[2] ..... G08B 17/00

[52] U.S. Cl. ..... 116/106; 116/217; 169/23

[58] Field of Search ..... 116/101, 106, 114.5, 116/114 S; 337/402, 414; 169/23

[56] References Cited

U.S. PATENT DOCUMENTS

| | | | |
|---|---|---|---|
| 2,670,194 | 2/1954 | Hansson | 116/114 S |
| 2,740,369 | 4/1956 | Thayer | 116/106 |
| 3,192,890 | 7/1965 | Smith | 116/106 X |
| 3,244,137 | 4/1966 | Garvey | 116/114.5 X |
| 3,530,817 | 9/1970 | Garvey | 116/106 |
| 3,803,527 | 4/1974 | Gallagher | 337/414 X |
| 3,804,054 | 4/1974 | Gallagher | 116/106 |

*Primary Examiner*—Daniel M. Yasich

*Attorney, Agent, or Firm*—Knobbe, Martens, Olson, Hubbard & Bear

[57] ABSTRACT

A manually operated release and test apparatus is disclosed for use with mechanically powered protection devices. A spring powered fire alarm, for example, is triggered either by exposure of its sensitive fusing element to a predetermined temperature, or by complete physical removal of the sensitive fusing element from the device. The release and test apparatus of this invention is a lever mounted on the alarm device for the consistent removal of the fuse assembly for testing the alarm while avoiding inflicting any damage thereto. This apparatus facilitates the testing and demonstration of the alarm device, without modifying the aesthetic appearance of the alarm. Also disclosed is a chain attachment which permits a remote force to be directly applied to the release lever so as to provide a release and test means for manual activation of the alarm in emergency situations.

13 Claims, 7 Drawing Figures

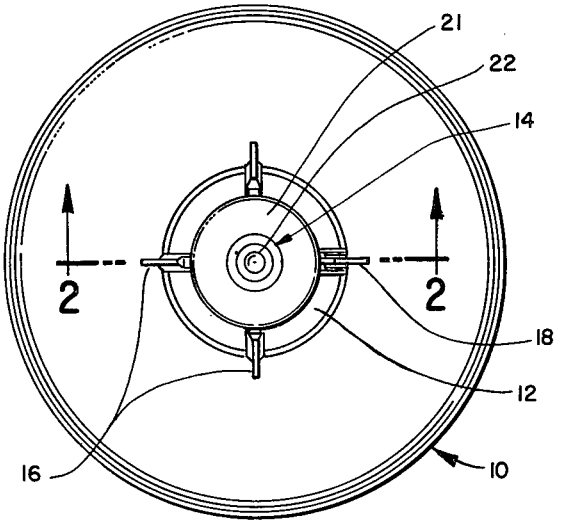
FIG. 1.
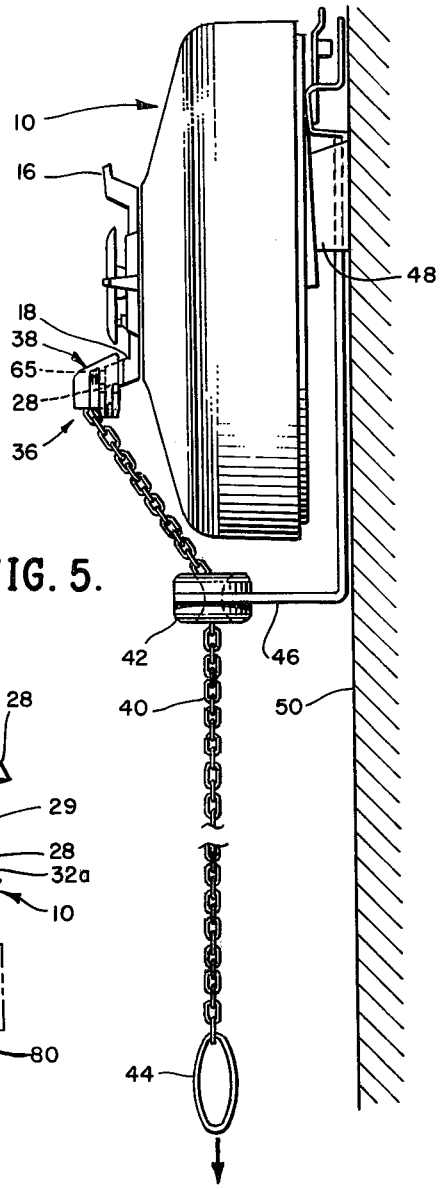
FIG. 5.
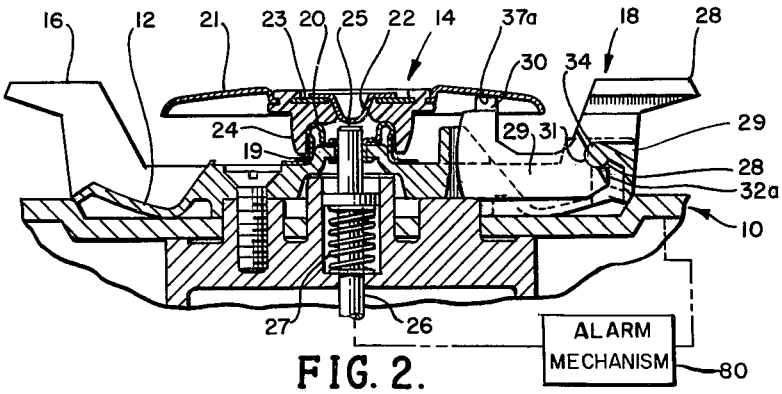
FIG. 2.
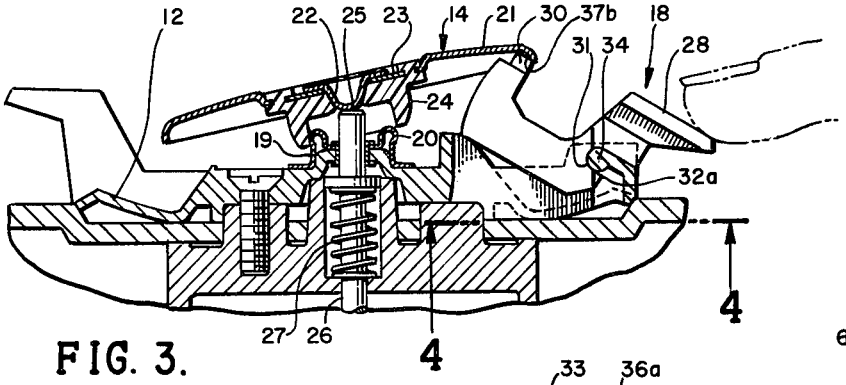
FIG. 3.
FIG. 6.
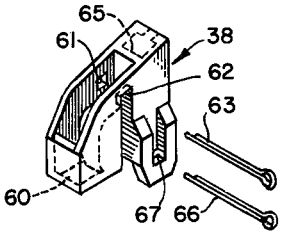
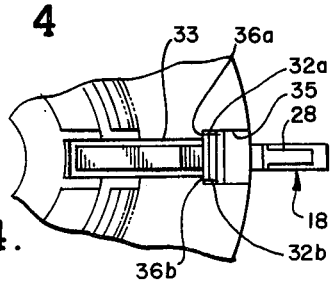
FIG. 4.
FIG. 7.
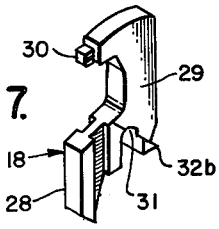

MANUAL RELEASE AND TEST APPARATUS FOR ALARM SYSTEM

BACKGROUND OF THE INVENTION

The present invention relates to alarm systems, such as fire and burglar alarms, and, more particularly, to apparatus for manually activating and testing the alarm mechanism of such systems. Reference is made to related U.S. Pat. No. 3,804,054, issued to Edward L. Gallagher; U.S. Pat. No. 3,803,527, issued to Edward L. Gallagher et al; and U.S. Pat. No. 3,795,983, issued to Edward L. Gallagher et al, all of which are assigned to A-T-O INC. assignee of this invention. These references all relate to alarm devices utilizing a trigger-actuated alarm mechanism which is particularly suitable for the present invention.

Alarm systems, such as fire and burglar alarm devices, are commonly used in many households and commercial facilities to protect such premises and their occupants. Because of the reliance that building occupants place upon such devices, it is imperative that they be simple, reliable and in good working order. It is, therefore, desirable that such alarm systems be tested when installed at regular intervals thereafter be following some routine test procedure.

Residential single station fire warning devices must be mounted on or near the ceiling of the subject premises in order to be effective. Thus positioned, alarm devices provided with testing means are rarely tested after installation because of the inconvenience in so doing. That is, the user of such a device has to precariously balance on a chair or ladder either to test the device in place, or to remove the alarm, test it on the ground and then replace it.

Moreover, while the usefulness of routinely testing an alarm is self evident, the construction of many alarms is such that heretofore, such testing often had to be very carefully performed. Thus, the manner in which an alarm is tested typically involves the removal of a very sensitive and delicate member in order to trigger the alarm. Fire alarms, for example, typically include a heat sensitive fuse assembly which includes a heat collector formed of a very thin metal member for increasing the responsiveness and sensitivity of the alarm to a fire condition. Such members must be very carefully removed from the alarm as bending or squeezing by finger pressure alone can easily cause a physical deformation thereof such as to prevent the alarm from functioning properly in case of fire.

Furthermore, the utility of alarm devices in certain locations is substantially lessened if they do not provide any quick and simple means for manual activation. Unless such means are provided, someone who fortuitously discovers a fire before it is large enough to trigger the fire alarm will not be able to activate the device and sound an audible alarm. Similarly, a fire protection device lacking a means for manual activation cannot serve to manually sound an alarm and scare off a burglar discovered in a residence.

SUMMARY OF THE INVENTION

The present invention provides for ease and uniformity in the testing, demonstration and manual activation of fire and burglar alarm systems. This manual release and test apparatus is particularly suited for use in alarm systems which require elevated mounting and which utilize heat sensitive fuse elements as a means for triggering a warning signal. The apparatus is essentially a lever which is mounted on the alarm system in close proximity to the fuse assembly, so as to forcibly remove it when a corresponding force is applied to the apparatus. The user of such an alarm system need only apply direct manual pressure to the apparatus in order to remove the fuse assembly and thereby trigger the alarm. Thus, the apparatus can function as means for testing or demonstrating the alarm mechanism, both prior to and after installation.

The present invention is designed to easily, uniformly and consistently remove a delicate fuse assembly, without causing any damage to it, each time a test or demonstration is to occur.

A particular feature of the present invention is that the test lever assembly advantageously replaces one of the protruding fingers heretofore used for protecting the heat sensitive fuse assembly from accidental contact with foreign objects. The test lever may be shaped to closely conform in appearance with such stationary protruding fingers so that neither the aesthetic appearance of the alarm nor the protective function of the fingers is adversely affected by the addition of the test lever.

Another feature of this invention is that the test lever advantageously comprises only a one piece test lever member which is inexpensively constructed and assembled.

The present invention also allows for ease in manually triggering an alarm system mounted in its typical elevated position on or near a ceiling. The release system consists essentially of a long chain which is attached at one end to the test lever described above, a pull ring which is attached to the other end of the chain which hangs freely, and a guide for the chain, which assures that a downward force applied to the pull ring will be transmitted to the lever with sufficient magnitude and direction to remove the fuse assembly. The length of the chain is such that the pull ring is within easy reach of an average alarm system user and, therefore, eliminates the need to use a ladder in order to actuate the alarm signal.

The manual release system allows a user of an elevated, heat sensitive alarm system to utilize it as an emergency warning device in panic situations, such as the discovery of a fire in its inception or of a burglary. The accessibility and ease of operation of the present invention make it particularly suitable as an early warning device in emergency situations.

These and other advantages of the present invention are best understood by reference to the drawings in which:

FIG. 1 is a front elevational view of the overall alarm system;

FIG. 2 is a sectional view of the alarm system in the vicinity of the fuse assembly taken along lines 2—2 of FIG. 1, showing its position with respect to the present invention;

FIG. 3 is a sectional view similar to FIG. 2, depicting actuation of the test lever;

FIG. 4 is a sectional view taken along the lines 4—4 of FIG. 3;

FIG. 5 is a side view of the alarm system in its mounted position, showing the test lever with the manual release attachment;

FIG. 6 is a perspective view of the chain connector member included in the manual release attachment; and FIG. 7 is a perspective view of the test lever.

DETAILED DESCRIPTION OF THE PREFERRED EMBODIMENT

Referring first to FIG. 1, the overall alarm system is shown to include a bell 10 supporting a base mount 12, with heat sensitive fuse assembly 14 centrally mounted thereon. Plural protective fingers 16 generally surround the fuse assembly 14 to shield it from accidental contact by foreign objects. As described below, in the preferred embodiment of the invention, one of these fingers 16 is replaced by test lever 18.

As shown in FIG. 2, a hollow protruding stud or collar 19 is secured to base mount 12. Collar 19 includes an enlarged, protruding ridge 20 near its outer extremity.

The fuse assembly 14 includes an extremely thin, circular heat collecting member 21 which is generally convex in shape. The thinness of the heat collecting member 21 allows the collection of heat from the ambient air over a large surface area while maintaining the mass of the heat collecting member 21 low, thereby allowing rapid temperature change in response to changes in the temperature of the surrounding air. Centered in the heat collecting member 21 is fuse member 22 connected to the heat collecting member 21 by a solder 23 made from an alloy which has a melting point temperature in the range which is achieved during the early stages of a building fire.

A circular retainer 24 advantageously formed from a suitable plastic is secured to the rear of the heat collecting member 21 and provides, with ridge 20 of collar 19, a snap on socket connection to mount the fuse assembly onto the base mount 12. When mounted as shown in FIG. 2, the bottom surface of fuse member 22 exerts a restraining force upon the juxtaposed end 25 of trigger means comprising a spring biased trigger pin 26 to maintain this pin in the position shown.

In this position the trigger pin 26 interferes with the spring powered alarm mechanism of the alarm system 80 such that no warning alarm is produced. In the event of a fire, the solder 23 holding fuse element 22 will melt. The end 25 of pin 26 will then push out fuse member 22 by virtue of the force exerted by compression spring 27. The opposite end of pin 26 (not shown) is then disengaged from the alarm mechanism causing the alarm system 80 to go off. The alarm system 80 may also be triggered by the complete removal of fuse assembly 14 from base mount 12 which also results in the release and disengagement of trigger pin 26. Such trigger-actuated spring powered alarm systems are well known in the art and one of which is disclosed in U.S. Pat. No. 3,804,054, issued to Edward L. Gallagher.

Referring to FIGS. 2, 4, and 7, test lever 18 is an integral one-piece member which includes finger element 28, extension arm 29, fuse engaging actuator tip 30, pivot notch 31 and retention ears **32*a* and 32*b*. Base mount 12 includes rectangular opening 33 which, as shown in FIG. 4, is sufficiently wide to receive and provide clearance for test lever 18. A fulcrum 34 is formed in base mount 12 at the outer end of opening 33. The semi-circular end of pivot notch 31 of lever 18 engages the corresponding arcuate surface of fulcrum 34 for allowing for pivotal movement of test lever within base mount 12. The pivotal travel of lever 18 is limited by retention ears 32*a* and 32*b* which are wider than the remainder of lever 18. These retention ears reside in an enlarged opening 35 of the base mount 12 below the fulcrum 34. When lever 18 is pivoted to the position shown in FIG. 3, these ears abut opposite corners 36*a* and 36*b* of the opening 35**.

During assembly of the alarm, lever 18 is merely inserted through opening 35 from the underside of base mount 12. Base mount 12 is then attached to the bell 10, thereby permanently securing lever 18.

The test lever 18 is so constructed that the engaging tip 30 is in close contact with the underside of the thin heat collecting member 21. Thus, when a downward force is applied to finger element 28 as shown in FIG. 3, a corresponding upward force is exerted by the tip 30 of the arm upon the member 21, thereby tilting member 21 until it is removed from its snap attachment thus allowing the release of trigger pin 25.

The engaging actuator tip 30 will make initial contact with the heat collecting member 21 at the point **37*a*, as shown in FIG. 2. The force exerted at point 37 will cause the circular retainer 24 to begin to lift off of ridge 20 of collar 19. As this lifting action continues, the engaging tip 30 will remain in contact with the underside of the fuse assembly until a final point 37*b* is reached and the retainer 24 is completely free of the snap on socket connection, as shown in FIG. 3**.

It will be seen from FIGS. 2 and 3 that the force required to remove fuse assembly 14 is not concentrated at one point on the assembly, but rather, is evenly distributed between initial point of contact **37*a* and final point of contact 37*b* on the heat collecting member 21. This distribution of force serves to protect this thin, metallic member against physical distortion. Furthermore, the close proximity of the tip 30 to the initial point of contact 37*a* avoids the possibility of sharp, sudden blows to the fuse assembly and thereby further prevents denting or bending of member 21**.

It will also be recognized that fuse assembly 14 will be both consistently and uniformly removed by the test lever 18. The fixed position of fulcrum 34, the secure mounting thereon of test lever 18, and the snap on socket attachment between circular retainer 24 and collar 19 all cooperate to remove the fuse assembly whenever sufficient force is applied to finger element 28. Moreover, removal of member 21 is accomplished with the minimum angle of lift of member 21 with respect to the horizontal, as shown in FIG. 3. As a result, the thin heat collecting member 21 will not be subjected to excessive rotational or vertical forces.

As shown in FIGS. 1 and 2, test lever 18 in its normal, non-actuated state, conforms closely in external appearance to the stationary protruding fingers 16. As a result, when the alarm is viewed from only a few feet away, the test lever is distinguishable from a stationary finger 16. In addition test lever 18 will also serve to shield the fuse assembly from accidental contact by foreign objects in the same manner as fingers 16. As a result, both the aesthetic appearance and function of the protective fingers are retained.

The integral one-piece construction of the test lever 18 provides for economical manufacture and assembly of the device. It will thus be apparent that no additional screws or other fastener means are necessitated by the device nor is any biasing spring needed to maintain the lever in position. Rather, as shown, the test lever 18 is retained in position by virtue of the close contact of the engaging tip 30 with the underside of the fuse assembly. As heretofore noted, this close contact also serves to inhibit the possibility of damage to the fuse assembly when the test lever 18 is activated so as to trigger the alarm.

A remote actuator 36 for the test lever 18 is shown in FIG. 5 comprising a chain connector member 38 which slides over and is secured to finger element 28 of test lever 18. A chain 40 is attached at one end to connector member 38 and extends down through a guide 42. Guide 42 is secured in position to the alarm 10 by bracket 46 which is in turn secured by wall attachment 48 used for attaching the alarm 10 to wall 50. A pull ring 44 is attached to the free end of chain 40. A strong cord or similar device can, of course, be substituted for chain 40.

A detailed view of chain connector member 38 is shown in FIG. 6. This member is advantageously molded of plastic and includes a chain receiving opening 60 and cotter pin receiving apertures 61, 62. The end of chain 40 extends through opening 60, is curved through an approximate 90° bend and secured to connector 38 by passing a cotter pin 63 through aperture 62, the end link of chain 40 and finally through aperture 61. Connector member 38 further includes a T-slot 65 which is complementary to the generally T-shaped outer configuration of finger element 28 of test lever 18. As shown in FIG. 5, the finger element 28 is received into this slot 65. A second cotter pin 66 (shown in FIG. 6) is passed through a second set of apertures (one of which is shown at 67 in FIG. 6) to lock the connector member 38 onto the test lever 18.

Remote actuator 36 acts in conjunction with test lever 18 to consistently and safely remove fuse assembly 14. In case of fire, burglary or other emergency, a manual, vertical force exerted on pull ring 44, in a downward direction, is transmitted via chain 40 and guide 42 to handle 38. The handle then exerts a corresponding force on finger 18. As shown in FIG. 3, and fuse assembly 14 is thereby removed and the alarm triggered. The cooperation between chain 40 and guide 42 is such that assembly removal occurs with the same features of consistency, uniformity and safety as described above.

It will be seen that the present invention provides for the testing, demonstration or manual activation of the alarm system, by manual force applied either directly to the test lever, functioning independently, or applied to the manual release system acting in conjunction with the test lever.

What is claimed is:

1. A manual release for a mechanical fire alarm including:

a base;

a heat collecting member of heat sensitive trigger means removable from said base and formed of thin metal which is easily physically distorted by finger pressure, said heat collecting member when removed from said base releasing means for causing said alarm to be triggered by biased means and to sound an audible alarm;

a plurality of protruding fingers supported by said base surrounding said heat collecting member; and a test lever pivotally mounted to said base and located in substantially the same relationship as said fingers, said test lever shaped to conform in appearance with said protruding fingers so as to be virtually indistinguishable therefrom, said lever including an actuator arm at its opposite end extending under and in close juxtaposition with the inside surface of said heat collecting member so that downward pressure on said test lever causes upward movement of said actuator arm for tilting said heat collecting member relative to said base member to a point at which said heat collecting member becomes disconnected from said base member, the area of force applied to said heat collector member by said actuator arm being shifted from one portion of said heat collector member to another as downward pressure is applied to said test lever, said shifting force area preventing any damage to said collector member.

2. A manual release for a mechanical alarm including:

a base;

a heat sensitive and delicate trigger member of trigger means removably attached to said base, said trigger member when removed from said base causing said alarm to be triggered by biased means and to sound an audible alarm; and a test lever pivotally mounted to said base and including an actuator arm at its opposite end extending under and in juxtaposition with the inside surface of said trigger member so that downward pressure on said test lever causes upward movement of said actuator arm for tilting said trigger member relative to said base member to a point at which said trigger member becomes disconnected from said base member, the point of contact of said actuator arm to said trigger member being shifted from one portion of said trigger member to another as downward pressure is applied to said test lever, said shifted contact point distributing the pressure exerted on said trigger member to prevent damage of said sensitive trigger member.

3. The manual release for a mechanical alarm as defined in claim 2 wherein:

said test lever is a unitary member having a pivot notch formed therein;

said base member having an opening therein for receiving said lever and a fulcrum at one end of said opening for pivotal engagement by said pivot notch.

4. The manual release for a mechanical alarm as defined in claim 2 wherein:

said test lever includes one or more protruding retention ears which reside in an enlarged opening in said base, said ear or ears engaging corners of said opening when said test lever has been pivoted through a predetermined arc about said fulcrum so that said ears both delimit pivotal movement of said test lever and retain said test lever to said base member.

5. A manual release for a mechanical alarm including:

a base;

a heat sensitive and delicate trigger member of trigger means removably attached to said base, said trigger member when removed from said base causing said alarm to be triggered by biased means and to sound an audible alarm; and a test lever pivotally mounted to said base and including an actuator tip end extending under and in close contact with the inside surface of said trigger member so that (i) downward pressure on said test lever causes upward movement of said actuator arm without producing a sharp, sudden blow on the trigger member for tilting said trigger member relative to said base member to a point at which said trigger member becomes disconnected from said base member, the point of contact of said actuator tip end to said trigger member being shifted from one portion of said trigger member to another as downward pressure is applied to said test lever, and (ii) the test lever is maintained in position without a bias return spring or the like.

6. An improved alarm system, comprising:

alarm means for the sounding of a warning signal;

trigger means connected to said power supply and including a removably attached sensitive and delicate trigger member having a fuse assembly, said trigger member when removed causing said alarm to be triggered by biased means; and means for testing said alarm system, comprising:

lever means attached to said alarm means for the application of a rotational force on said fuse assembly whenever a corresponding force is applied to said lever means, said lever means being in close contact with said trigger member so that said rotational force will not produce a sudden blow on said trigger member thereby removing said trigger member without damaging or distorting said trigger member and actuating said trigger means.

7. The improved alarm system as defined in claim 6 wherein said means for testing includes an elongate manual release means attached to said lever means for the application of a force on said lever means by applying a corresponding force on said manual release means at a distance from said alarm system.

8. In an alarm system which includes alarm means, a power supply for powering said alarm means, trigger means connected to said power supply and including a removably attached sensitive and delicate trigger member having a fuse assembly, said trigger member when removed causing said alarm to be triggered by biased means wherein the improvement comprises:

lever means, comprising:

a first end for the reception of a force;

a second end for the exertion of a force corresponding to that received by said first end; and fulcrum means located between said first and second ends;

said lever means mounted on said alarm means at said fulcrum means so as to allow partial rotation of said lever means about said fulcrum means; and said second end of said lever means being in close contact with said trigger member exerting a uniform force for removing said trigger member from said alarm means, thereby actuating said trigger means, whenever a corresponding force is applied to said first end of said lever means.

9. The improved alarm system as defined in claim 8 wherein the force exerted on said fuse assembly by said second end of said lever means is sufficient to remove said fuse assembly without causing permanent physical distortion or other damage thereto.

10. In an alarm system which includes alarm means, a power supply for powering said alarm means, trigger means connected to said power supply and including a removably attached sensitive and delicate trigger member having a fuse assembly, said trigger member when removed causing said alarm to be triggered by biased means, wherein the improvement comprises:

lever means, comprising:

a first end for the reception of a force; and a second end for the exertion of a force corresponding to that received by said first end;

fulcrum means located between said first and second ends;

said lever means mounted on said alarm means at said fulcrum means so as to allow partial rotation of said lever means about said fulcrum means; and a manual release system, comprising:

line means attached at one end to said first end of said lever means; and guide means attached to said alarm means and aligned to receive the free end of said line means; and said line means acting in cooperation with said guide means to apply a force to said first end of said lever means, and said second end of said lever means exerting a uniform force for removing said trigger member from said alarm means, thereby actuating said trigger means, whenever a force is applied to said line means.

11. In an alarm system which includes alarm means, a power supply for powering said alarm means, trigger means connected to said power supply and including a removably attached sensitive and delicate trigger member having a fuse assembly, said trigger member when removed causing said alarm to be triggered by biased means, and plural protruding finger elements for the protection of said fuse assembly, wherein the improvement comprises:

a test lever, formed by one of said finger elements, said lever comprising:

an arm extension on said one of said finger elements;

fulcrum means for rotatable mounting said test lever on said alarm means; and said arm extension forcibly removing said trigger member from said alarm means, thereby actuating said trigger means, whenever a force is applied to said one of said finger elements.

12. In an alarm system which includes alarm means, a power supply for powering said alarm means, trigger means connected to said power supply and including a removably attached sensitive and delicate trigger member having a fuse assembly, said trigger member when removed causing said alarm to be triggered by biased means, and plural protruding finger elements for the protection of said fuse assembly, wherein the improvement comprises:

a test lever formed by one of said finger elements, said lever comprising:

an arm extension on said one of said finger elements; and fulcrum means for rotatable mounting said test lever on said alarm means;

a manual release system, comprising:

a connector member adapted to be joined to said one of said finger elements;

a hollow guide attached to and extending below said alarm means;

an elongate flexible chain attached at one end to said one of said finger elements, the other end running through said hollow guide and hanging freely; and a circular ring, attached to the free end of said chain to receive a manual force; and said manual release system applying a force on said one of said finger elements, and said arm extension forcibly removing said trigger member from said alarm means, thereby actuating said trigger means, whenever a corresponding force is applied to said circular ring of said manual release system.

13. A manual release for a mechanical fire alarm including:

a base;

a heat collecting member of trigger means removable from said base and formed of thin metal which is easily physically distorted by finger pressure, said heat collecting member when removed from said base causing said alarm to be triggered and to sound an audible alarm;

a plurality of protruding fingers supported by said base surrounding said heat collecting member;

a test lever pivotally mounted to said base and located in substantially the same relationship as said fingers, said test lever shaped to conform in appearance with said protruding finger so as to be virtually indistinguishable therefrom, said lever including an actuator arm at its opposite end and a pivot notch having an arcuate portion located between opposite ends of said test lever;

said base having an opening therein for receiving said test lever and a fulcrum at one end of said opening having an arcuate portion for pivotal engagement by an arcuate portion of said pivot notch, so as to allow pivotal movement of said lever about said fulcrum;

said actuator arm extending under and in juxtaposition with the inside surface of said heat collecting member so that downward pressure on said test lever causes upward movement of said actuator arm for tilting said heat collecting member relative to said base member to a point at which said heat collecting member becomes disconnected from said member, the area of the force supplied to said heat collector member by said actuator arm being shifted from one portion of said heat collector to another as downward pressure is applied to said test lever;

said actuator arm being in close contact with the inside surface of said heat collecting member so that (i) downward pressure on said test lever will not produce a sharp, sudden blow on the trigger member and (ii) the test lever is maintained in position without a bias return spring or the like.

* * * * *

UNITED STATES PATENT AND TRADEMARK OFFICE

CERTIFICATE OF CORRECTION

PATENT NO. : 4,154,189

DATED : May 15, 1979

INVENTOR(S) : Edward L. Gallagher

It is certified that error appears in the above-identified patent and that said Letters Patent are hereby corrected as shown below:

Column 1, line 25, "be" should be --by--

Column 4, line 51, "distinguishable" should be --indistinguishable--

Signed and Sealed this

*Twenty-fifth* Day of *September 1979*

[SEAL]

*Attest:*

*Attesting Officer*

LUTRELLE F. PARKER

*Acting Commissioner of Patents and Trademarks*